US006668904B1

(12) United States Patent
Johansen

(10) Patent No.: US 6,668,904 B1
(45) Date of Patent: Dec. 30, 2003

(54) METHOD AND APPARATUS FOR PRODUCING CASTING MOULDS OR MOULD PARTS

(75) Inventor: Jan Bechmann Johansen, Humlebæk (DK)

(73) Assignee: Disa Industries A/S, Herlev (DK)

( * ) Notice: Subject to any disclaimer, the term of this patent is extended or adjusted under 35 U.S.C. 154(b) by 0 days.

(21) Appl. No.: 10/181,807

(22) PCT Filed: Feb. 4, 2000

(86) PCT No.: PCT/DK00/00047

§ 371 (c)(1),
(2), (4) Date: Jul. 23, 2002

(87) PCT Pub. No.: WO01/56723

PCT Pub. Date: Aug. 9, 2001

(51) Int. Cl.[7] ..... B22C 9/03; B22C 9/20; B22C 15/24

(52) U.S. Cl. ..... 164/7.1; 164/20; 164/160.1; 164/200; 164/322

(58) Field of Search ..... 164/7.1, 18–21, 164/27, 29, 200–202, 322–324, 160.1

(56) References Cited

U.S. PATENT DOCUMENTS 4,538,665 A * 9/1985 Uzaki et al. ..... 164/160.1
5,161,603 A * 11/1992 Volkomich et al. ..... 164/7.1

* cited by examiner

*Primary Examiner*—Kuang Y. Lin
(74) *Attorney, Agent, or Firm*—Larson & Taylor PLC

(57) ABSTRACT

In a mould forming machine comprising a moulding chamber, a movable squeeze plate and a pattern, the filling of selected parts of the pattern with compressible mould material is improved by applying vacuum to said selected parts. By applying the vacuum separately to different parts of the pattern at different periods, of time during the filling step, the vacuum application can be applied during shorter periods only when needed, thereby reducing the drying out of the mould material and reducing the amounts of air to be removed by the vacuum system.

14 Claims, 3 Drawing Sheets

RELEASE MOVEMENT
SOUEEZE MOVMENT
100%
50%
t
FILLING
100%
0%
H1
P13
ATM
VACUUM
P12
ATM
P11
ATM

METHOD AND APPARATUS FOR PRODUCING CASTING MOULDS OR MOULD PARTS

TECHNICAL FIELD

The present invention relates to a method and apparatus for producing moulds or mould parts In a mould-forming machine comprising at least one moulding chamber with at least one movable squeeze plate and at least one pattern, such as a string moulding-apparatus, a flaskless mould-forming machine or the like, in which the mould-forming process comprises the steps of filling the moulding chamber (s) with compressible mould material, e.g. clay-bonded green sand, applying a vacuum at selected parts of the pattern(s) during said filling, and pressing the mould material by moving the squeeze plate(s), thus forming the mould or mould parts (cope and drag), the moulding cavities being provided in the produced mould or mould parts by means of the pattern plate(s). After pressing the mould material, the produced mould or mould parts are removed from the moulding chamber(s), whereafter the moulding chamber is reclosed and made ready for a new cycle.

BACKGROUND ART

A method and apparatus of this general kind is e.g. known from U.S. Pat. No. 4,791,974. According to this document, the filling of the moulding chamber with compressible mould material, e.g. clay-bonded green sand, is improved by applying a vacuum to selected parts of the pattern(s) through air-permeable chamber walls during the whole filling step and possibly before starting the filling, thus avoiding the formation of air pockets in depressions in the pattern(s) that could otherwise cause reduced compactness and density in protruding parts of the mould or mould parts being formed in the moulding chamber. In the above document, the vacuum is applied during the whole filling step, whereby the surface of the produced mould or mould parts is dried out and the amount of air to be removed is relatively high, resulting in a demand for relatively large channels for removing the air. Furthermore, the drying-out of the surface of the produced mould or mould parts is effected in positions where this drying out is highly unwanted and which produces a difference in quality of the mould surface and accordingly the surface of the moulded products produced in the moulds. U.S. Pat. No. 5,332,025 correspondingly discloses a method and apparatus for filling sand moulds in a string moulding machine in which vacuum or gas pressure can be applied to the sand in the moulding chamber. A valve connects the moulding chamber either to a pressure or vacuum source. The application of vacuum results in the same disadvantages of drying out the mould, as described above for U.S. Pat. No. 4,791,974.

DISCLOSURE OF THE INVENTION

It is the object of the present invention to provide a method and an apparatus, which improves the mould quality of a mould-forming machine of the kind referred to above, which alleviates the above-mentioned problems, thus resulting in a higher quality of the produced moulds and a more efficient utilisation of the vacuum. This object is achieved with a method and apparatus of said kind, wherein vacuum can be applied separately to different parts of the pattern(s), during such periods of times during which the vacuum is efficient to improve the filling of said different parts. Preferred embodiments of the invention are also revealed hereinafter.

BRIEF DESCRIPTION OF THE DRAWINGS

In the following detailed part of the description, the invention will be explained in more detail with reference to the exemplary embodiments of the method and apparatus in accordance with the invention shown in the drawings, in which FIG. 4 shows a plot of the application of vacuum to different parts of the patterns during the filling step and during the initial part of the pressing step.

DESCRIPTION OF THE PREFERRED EMBODIMENTS

Figure 1:
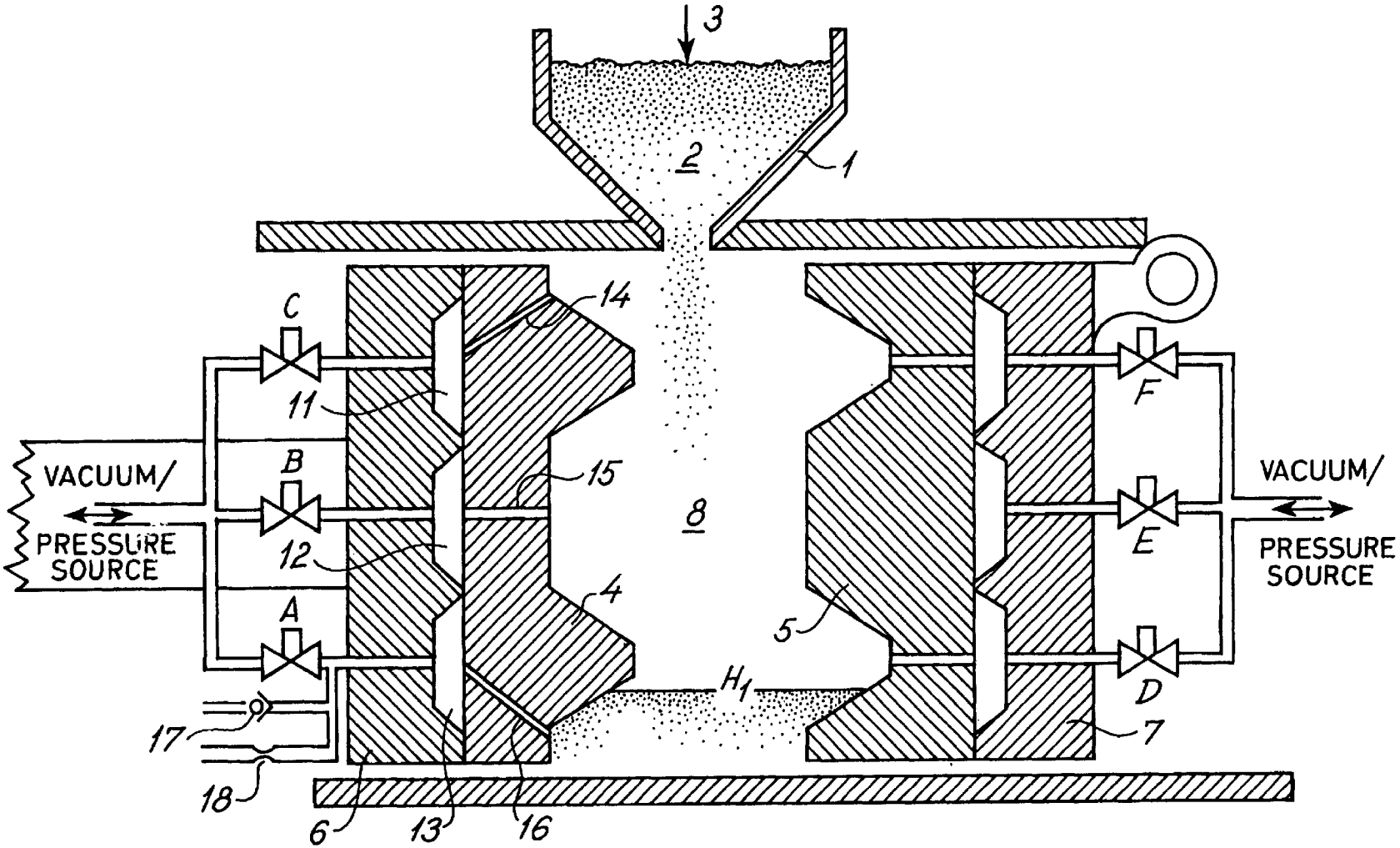
FIG. 1 shows a string-moulding apparatus in the filling position.
Figure 2:
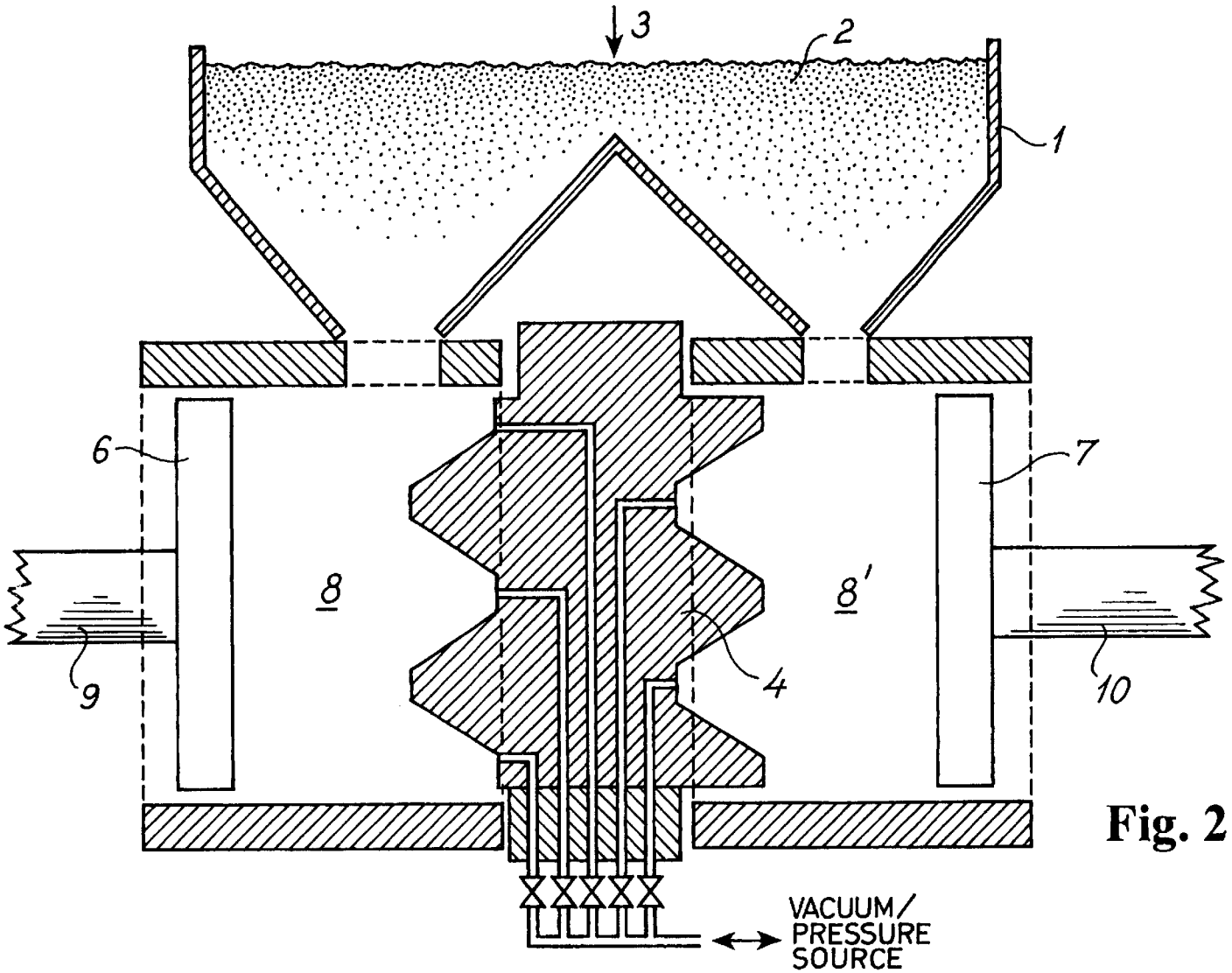
FIG. 2 shows a flaskless mould-forming machine in the filling position.

FIGS. 1 and 2 shows two different types of mould-forming machines in the filling position. In FIG. 1, the mould-forming machine is a string-moulding apparatus comprising a moulding chamber 8, the one end of which is closed by a squeeze plate 6 carrying a pattern 4, and the other end being closed by a pivoted squeeze plate 7 carrying a pattern 5. In the filling position shown in FIG. 1, the moulding chamber 8 is filled with compressible mould material 2 from a hopper 1, the mould material 2 being driven into the moulding chamber 8 by air pressure 3 applied to the top of the mould material 2.

FIG. 2 illustrates a flaskless mould-forming machine in the filling position. In this apparatus, the moulding chamber 8, 8' is divided into two parts by a pattern 4 and the moulding chamber is closed at one end by a squeeze plate 6 and at the other end by a squeeze plate 7. The moulding chamber 8, 8' is filled with compressible mould material 2 from a hopper 1 through separate openings into the two parts 8, 8' in the moulding chamber.

Figures 3, 4A, 4B, 4C:
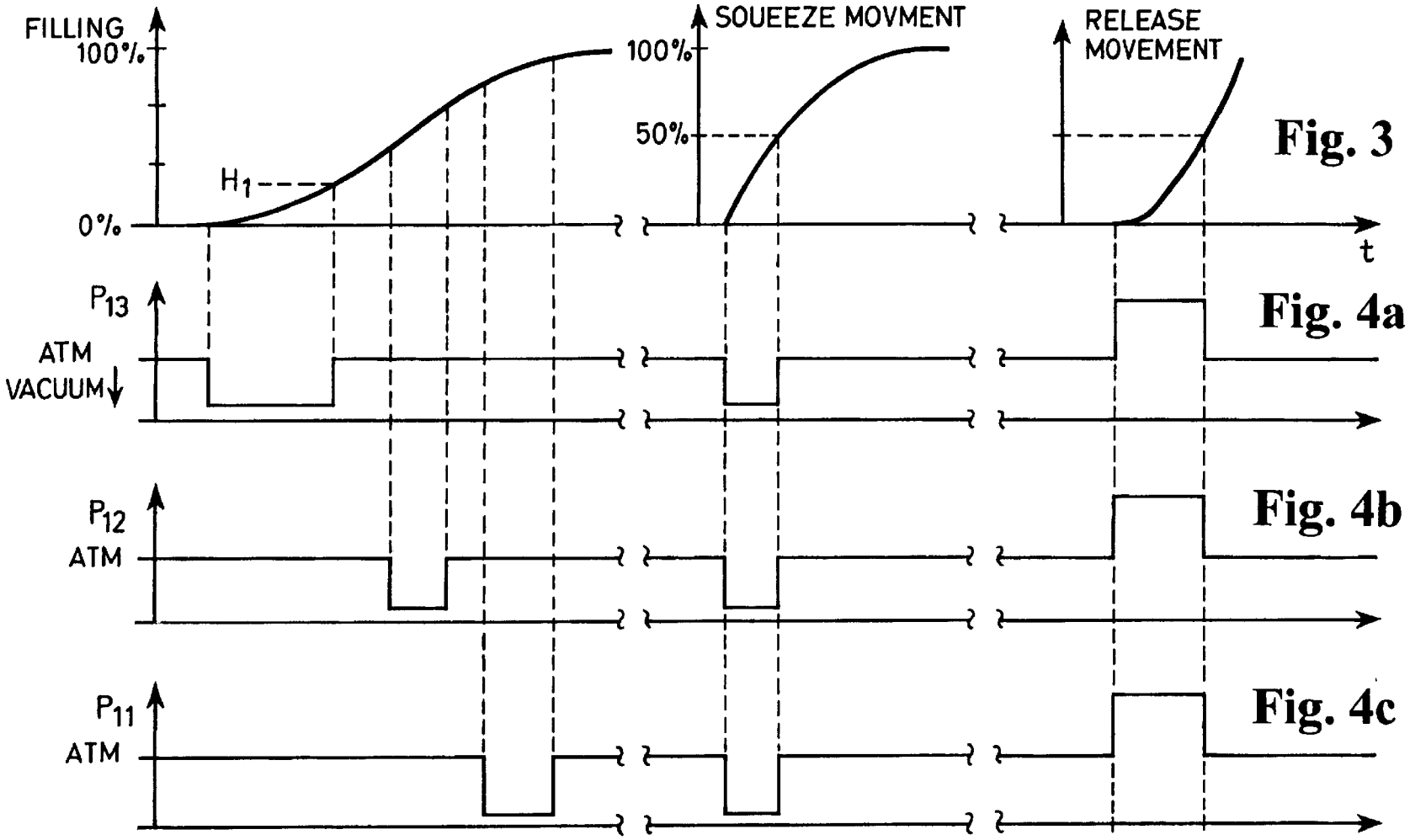
FIG. 3 shows a plot of the sand filling level versus time.

FIGS. 1 and 2 shows how a vacuum source is connected to different parts of the patterns 4, 5 via separate valves A–F. This provides a possibility of applying the vacuum to different selected parts of the patterns 4, 5 at different periods of time during the filling step. FIG. 3 shows how the filling of the moulding chamber 8, 8' progresses with time from 0–100%, and FIG. 4 shows correspondingly how the vacuum is applied to the different selected parts of the pattern during the filling. As shown in FIG. 1, the vacuum is applied to the bottom parts of the pattern 4 via the valve A connecting the vacuum to the chamber 13 and the channel 16 shown in FIG. 1. This vacuum is applied a certain time before the filling starts and is terminated when the filling level reaches the level $H_1$ as indicated in FIGS. 1 and 3. Correspondingly, vacuum is applied via the valves B and C during successive time periods as indicated in FIG. 4, starting immediately before the mould material 2 level reaches the corresponding level of the selected parts of the pattern 4 connected to the individual valves via the channels 14, 15 and the chambers 11, 12.

The control of the application of the vacuum may be performed in accordance with measurement of the mould material level in the moulding chamber 8, 8' or as an alternative the level may be calculated empirically setting up a formula for the mould material level as a function of time. Preferably, the vacuum is applied to the different selected parts of the patterns 4, 5 only during short periods of time, corresponding to the time immediately before the mould material level reaches the lower part of the selected parts and until shortly after the mould material level reaches the upper parts of said selected parts, thus avoiding drying out of said parts due to the application of vacuum. Furthermore, this scheme will reduce the amounts of air to be withdrawn by the vacuum system, whereby the dimensioning of the connections can be minimised. It will further be appreciated that positioning of the valves A–F close to the selected parts of the pattern plates 4, 5 will minimise the time delay from activating the valves until vacuum is actually applied to the selected parts.

If considered appropriate, vacuum may furthermore be applied to selected parts of the patterns 4, 5 during the initial part of the squeezing step, thereby possibly further improving the filling of the selected parts of the pattern plates 4, 5 during the squeezing. The application of vacuum during squeezing is preferably performed during a short time period corresponding to e.g. the initial 30–50% movement during the squeezing step.

The mould-forming machine is further provided with means for measuring the movement of the at least one squeeze plate during the pressing movement thereof and for controlling said means for selectively connecting the vacuum source to selected parts of the at least one pattern in dependence of the measured movement.

After squeezing, the produced mould or mould parts are removed from the moulding chamber 8, 8', said removal comprising releasing the mould or mould parts from the pattern or pattern(s) 4, 5 and this releasing may be promoted by applying a pressure to selected parts of the patterns 4, 5, using the connections of the moulding chamber for applying vacuum during the filling, and possibly the squeezing.

Preferably each of the chambers 11, 12, 13 are connected to the surrounding atmosphere via a non-return valve 17 in order to enable escape of air from the moulding chamber through the channels 14, 15, 16 when no vacuum is applied through the valves A, B, C. This may further provide a possibility of using the system without application of vacuum when producing moulds or mould parts without the need for application of vacuum.

Furthermore, each of these chambers 11, 12, 13 may be connected to the surrounding atmosphere via a throttle valve 18, in order to equalize the pressure when the vacuum is shut off.

Although the above description only refers to the valves A, B, C, the chambers 11, 12, 13 and the channels 14, 15, 16, it will be evident how the further valves D, E, F and corresponding elements function in a similar way.

What is claimed is:

1. Method of producing casting moulds or mould parts in a mould forming machine comprising at least one moulding chamber with at least one movable squeeze plate and at least one pattern, said method comprising the steps of:

a) filling the at least one moulding chamber with compressible mould material, b) applying a vacuum at selected parts of the at least one pattern during said filling step, c) pressing the mould material by moving the at least one squeeze plate, and d) removing the produced mould or mould parts from the at least one moulding chamber, making the at least one moulding chamber ready for a new cycle starting from the filling step, said method being characterized by further comprising the steps of b1) applying said vacuum to at least two different parts of the at least one pattern at different periods of time during said filling step.

2. Method in accordance with claim 1, characterized by further comprising the step of b2) synchronizing the application of said vacuum to the respective at least two different parts of the at least one pattern with respective time periods, during which said different parts are filled with compressible mould material.

3. Method in accordance with claim 2, characterized by further comprising the step of b3) extending the time period during which said different parts are filled with compressible mould material and during which said vacuum is applied by a certain time period therebefore and/or thereafter.

4. Method in accordance with claim 1, characterized by further comprising the step of c1) applying a vacuum to parts of the at least one pattern during an initial part of the pressing step.

5. Method in accordance with claim 1, characterized by further comprising the step of c2) applying a vacuum to parts of the at least one pattern during an initial 30%–50% movement during the pressing step.

6. Method in accordance with claim 1, characterized by further comprising the step of enabling escape of air from the different parts of the at least one pattern when no vacuum is applied.

7. Method in accordance with claim 1, characterized by further comprising the step of equalizing the vacuum in the different parts of the at least one pattern when vacuum is no longer applied.

8. Apparatus for producing casting moulds or mould parts, comprising at least one moulding chamber with at least one movable squeeze plate and at least one pattern, filling means adapted to introduce compressible mould material into the at least one moulding chamber, and a vacuum source selectively connectable to passages leading to selected parts of the at least one pattern characterized by further comprising means for selectively connecting said vacuum source to at least two different parts of the at least one pattern, said different parts being located at different levels at each pattern that the different parts are filled with mould material during different time intervals, said means for selectively connecting said vacuum source comprising separate valves connected to said at least two different parts of the at least one pattern and said valves being opened and closed at different points of time.

9. Apparatus in accordance with claim 8, characterized by further comprising means for performing said selective connection of said vacuum source to said different parts of the at least one pattern which is synchronized with the filling of the at least one moulding chamber.

10. Apparatus in accordance with claim 8, characterized by comprising means for measuring the filling level in the at least one moulding chamber and controlling the vacuum application in dependence of said measurement.

11. Apparatus in accordance with claim 8, characterized by further comprising means for selectively connecting the vacuum source to selected parts of the at least one pattern during an initial pressing movement the at least one squeeze plate.

12. Apparatus in accordance with claim 11, characterized by further comprising means for measuring the movement of the at least one squeeze plate during the pressing movement thereof and for controlling said means for selectively connecting the vacuum source to selected Parts of the at least one pattern in dependence of said measured movement.

13. Apparatus in accordance with claim 8, characterized by further comprising means for enabling escape of air from the different parts of the at least one pattern when no vacuum is applied.

14. Apparatus in accordance with claim 8, characterized by further comprising means for equalizing the vacuum in the different parts of the at least one pattern, when the vacuum is no longer applied.

* * * * *